US010984722B2

(12) United States Patent
Zhu et al.

(10) Patent No.: US 10,984,722 B2
(45) Date of Patent: Apr. 20, 2021

(54) PIXEL CIRCUIT, METHOD FOR DRIVING PIXEL CIRCUIT, DISPLAY PANEL, AND DISPLAY APPARATUS

(71) Applicant: KUNSHAN GO-VISIONOX OPTO-ELECTRONICS CO., LTD., Kunshan (CN)

(72) Inventors: Zhengyong Zhu, Kunshan (CN); Longfei Fan, Kunshan (CN); Hui Zhu, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 16/841,713

(22) Filed: Apr. 7, 2020

(65) Prior Publication Data

US 2020/0234648 A1 Jul. 23, 2020

Related U.S. Application Data

(63) Continuation of application No. PCT/CN2019/079622, filed on Mar. 26, 2019.

(30) Foreign Application Priority Data

Sep. 28, 2018 (CN) ..... 201811141850.8

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2320/0233* (2013.01); *G09G 2320/0626* (2013.01)

(58) Field of Classification Search
None
See application file for complete search history.

(56) References Cited

U.S. PATENT DOCUMENTS

2007/0040772 A1 2/2007 Kim
2011/0134100 A1 6/2011 Chung et al.
(Continued)

FOREIGN PATENT DOCUMENTS

CN 103971640 A 8/2014
CN 104064139 A 9/2014
(Continued)

OTHER PUBLICATIONS

CN First Office Action dated Nov. 12, 2019 in the corresponding CN application(application No. 201811141850.8).
(Continued)

*Primary Examiner* — Aneeta Yodichkas
(74) *Attorney, Agent, or Firm* — Kilpatrick Townsend & Stockton LLP

(57) ABSTRACT

The present disclosure provides a pixel circuit, a method for driving a pixel circuit, a display panel, and a display apparatus. The pixel circuit includes a first transistor, a second transistor, a third transistor, a fourth transistor, a fifth transistor, a sixth transistor, a seventh transistor, a capacitor, and a light-emitting diode. In the above pixel circuit, the first light emitting control signal and the second light emitting control signal are provided to respectively initialize the first polar plate and the second polar plate of the capacitor, to ensure the same initial state of the pixel circuits.

15 Claims, 2 Drawing Sheets

(56) References Cited

U.S. PATENT DOCUMENTS

| | | | |
|---|---|---|---|
| 2015/0356916 | A1 | 12/2015 | Qian |
| 2017/0047002 | A1 | 2/2017 | Xuan et al. |
| 2019/0096337 | A1 | 3/2019 | Zhu et al. |
| 2019/0295468 | A1 | 9/2019 | Ji et al. |
| 2019/0295476 | A1 | 9/2019 | Ji et al. |

FOREIGN PATENT DOCUMENTS

| | | | |
|---|---|---|---|
| CN | 107221289 | A | 9/2017 |
| CN | 107680533 | A | 2/2018 |
| CN | 207352944 | U | 5/2018 |
| CN | 108231005 | A | 6/2018 |
| CN | 207474026 | U | 6/2018 |
| CN | 108564920 | A | 9/2018 |
| CN | 109192143 | A | 1/2019 |
| JP | 2006023516 | A | 1/2006 |
| WO | 2018090620 | A1 | 5/2018 |
| WO | 2019184266 | A1 | 10/2019 |

OTHER PUBLICATIONS

Office Action of Chinese Patent Application No. 201811141850.8.
International Search Report of International Patent Application No. PCT/CN2019/079622.

PIXEL CIRCUIT, METHOD FOR DRIVING PIXEL CIRCUIT, DISPLAY PANEL, AND DISPLAY APPARATUS

CROSS-REFERENCES TO RELATED APPLICATIONS

The present application is a continuation application of the PCT application No. PCT/CN2019/079622, filed on Mar. 26, 2019 and titled "Pixel Circuit, Method For Driving Pixel Circuit, Display Panel, And Display Apparatus", which claims the priority of the Chinese Patent Application No. 201811141850.8, filed on September 28, entitled "Pixel Circuit, Method For Driving Pixel Circuit, Display Panel, And Display Apparatus", and the contents of the both applications are incorporated by reference herein in their entireties.

TECHNICAL FIELD

The present disclosure relates to the field of display technology.

BACKGROUND

Organic light-emitting display panels are more and more widely used in the field of display technology due to their benefits of high contrast, low power consumption, wide viewing angle, fast response speed. An organic light-emitting display panel is usually provided with pixel circuits arranged in an array. The pixel circuit usually includes a plurality of light-emitting diodes and a power supply.

SUMMARY

The present disclosure provides a pixel circuit, a method for driving a pixel circuit, a display panel, and a display apparatus.

A pixel circuit is provided, including a first transistor, a second transistor, a third transistor, a fourth transistor, a fifth transistor, a sixth transistor, a seventh transistor, a capacitor, and a light-emitting diode.

A control end of the fourth transistor configured to input the first scanning signal, a first electrode of the fourth transistor respectively connected to a second electrode of the third transistor, a control end of the first transistor, and a first polar plate of the capacitor, a second electrode of the fourth transistor connected to a second electrode of the seventh transistor T7 and configured to input a first reference voltage.

A control end of the third transistor configured to input a second scanning signal, a first electrode of the third transistor respectively connected to a second electrode of the first transistor and a first electrode of the sixth transistor, a first electrode of the first transistor configured to input a first power voltage.

A control end of the sixth transistor configured to input a first light emitting control signal, a second electrode of the sixth transistor respectively connected to an anode of the light-emitting diode and a first electrode of the seventh transistor, a cathode of the light-emitting diode configured to input a second power supply voltage, a control end of the seventh transistor configured to input the first scanning signal.

A control end of the second transistor configured to input a second scanning signal, a first electrode of the second transistor configured to input a data voltage, a second electrode of the second transistor respectively connected to a second polar plate of the capacitor and a second electrode of the fifth transistor.

A control end of the fifth transistor configured to input a second light emitting control signal, a first electrode of the fifth transistor configured to input a second reference voltage.

Optionally, a voltage value of the first reference voltage is less than a voltage value of the second power supply voltage.

Optionally, the first transistor, the second transistor, the third transistor, the fourth transistor, the fifth transistor, the sixth transistor, and the seventh transistor are P-type transistors or N-type transistors.

Optionally, the first transistor, the second transistor, the third transistor, the fourth transistor, the fifth transistor, the sixth transistor, and the seventh transistor include any one of a low-temperature polysilicon thin film transistor, an oxide semiconductor thin film transistor, and an amorphous silicon thin film transistor.

Optionally, the second transistor, the third transistor, the fourth transistor, the fifth transistor, the sixth transistor, and the seventh transistor are switching transistors, and the first transistor is a driving transistor.

Optionally, the capacitor is an energy storage capacitor, and the light-emitting diode is an organic light-emitting diode.

Optionally, a control end of each transistor is a gate of the each transistor, a first electrode of each transistor is a source of the each transistor, and a second electrode of each transistor is a drain of the each transistor.

Optionally, the first power supply voltage is a positive voltage, and the second power supply voltage is a negative voltage.

A display panel is provided, including a plurality of pixel circuits arranged in an array, the pixel circuit being the above-mentioned pixel circuit.

A display apparatus is provided, including the above mentioned display panel.

A method for driving a pixel circuit is provided, the pixel circuit includes the above-mentioned pixel circuit, and the method includes: during an initialization phase, setting a first scanning signal and a second light emitting control signal as a low level signal, setting a second scanning signal and a first light emitting control signal as a high level signal, and utilizing a first reference voltage to initialize the pixel circuit; during a data writing phase, setting the second scanning signal as a low level signal, and setting the first scanning signal, the first light emitting control signal, and the second light emitting control signal as a high level signal, writing the data voltage into the pixel circuit; during a light emitting phase, setting the first light emitting control signal and the second light emitting control signal as a low level signal, setting the first scanning signal and the second scanning signal as a high level signal, the light-emitting diode emitting light.

Optionally, during the initialization phase, the first scanning signal controls the fourth transistor and the seventh transistor to switch on; the first reference voltage is utilized to initialize a control end of the first transistor and a first polar plate of the capacitor through the fourth transistor, the first transistor is switched on; the first reference voltage is utilized to initialize an anode of the light-emitting diode through the seventh transistor; and the second light emitting control signal controls the fifth transistor to switch on, and a second reference voltage is utilized to initialize the second polar plate of the capacitor through the fifth transistor.

Optionally, a voltage value of the first reference voltage is less than a voltage value of the second power supply voltage, to ensure that the light-emitting diode doesn't emit light during the initialization phase.

Optionally, during the data writing phase, the second scanning signal controls the second transistor to switch on, and the data voltage is written into the second polar plate of the capacitor through the second transistor.

Optionally, during the light emitting phase, the second light emitting control signal controls the fifth transistor to switch on, and the second reference voltage is utilized to compensate for a voltage of the first transistor through the fifth transistor and the capacitor, to make a current flowing through the first transistor independent of the first power supply voltage.

The above-mentioned control method for the pixel circuit compensates for the current-resistance voltage drop on the first power supply wire by adding the second reference voltage, and meanwhile compensates for the effect caused by the threshold voltage on the light emitting current, thereby improving the uniformity of the light emission of the screen body.

DETAILED DESCRIPTION OF THE INVENTION

The current flowing through the light-emitting diodes is related to the power supply voltage. In the display panel, since the distance between each light-emitting diode and the power supply is different, the voltage drop on the wire produced during the voltage transmission is also different, and the power supply voltage actually obtained by each light-emitting diode is different. Therefore, the current flowing through each light-emitting diode is different, the brightness of each light-emitting diode is different, resulting in that the brightness of light emission of the display panel is non-uniform.

In order to make the objectives, features, and advantages of the present disclosure more comprehensible, the specified embodiments of the present disclosure will be illustrated in detail with reference to the accompanying drawings. The description below provides details to fully understand the present disclosure. However, the present disclosure can be implemented in many modes other than these described herein. Those skilled in the art can make similar improvements without departing from the conception of the present disclosure. Therefore, the present disclosure is not limited by the following specific embodiments.

It should be noted that when an element is described as being "arranged on" another element, it can be arranged directly on another element, or via an intermediate element. When an element is considered to be "connected" to another element, it can be connected directly to another element, or via an intermediate element. The terms of "vertical", "horizontal", "left", "right" and the similar expressions used herein are merely for the purpose of illustration, and do not imply they are the only implementation modes.

Figure 1:
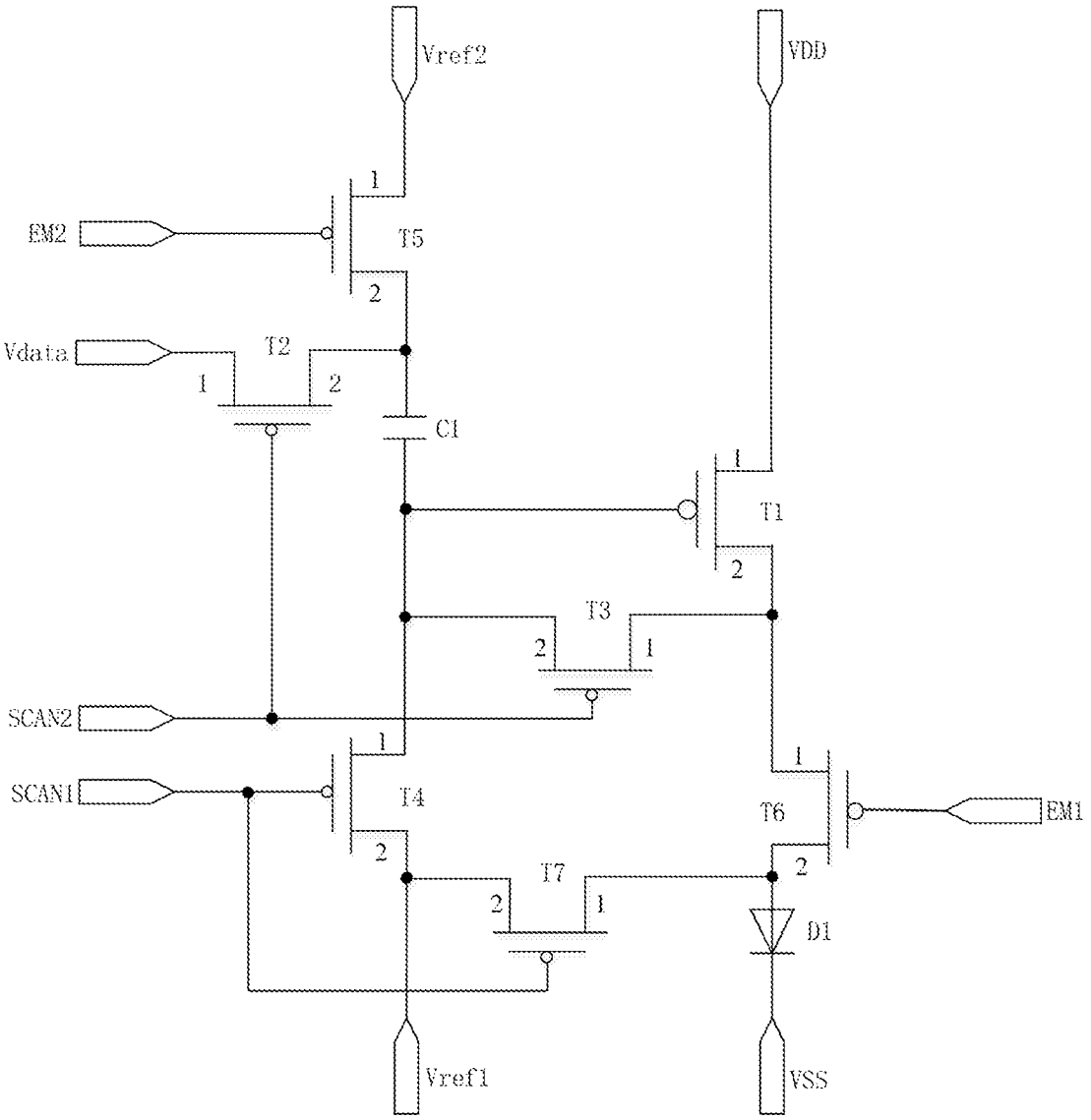
FIG. 1 shows a schematic diagram illustrating a pixel circuit according to an embodiment of the present disclosure.

Referring to FIG. 1, Optionally of the present disclosure, a pixel circuit is provided, which includes a first transistor T1, a second transistor T2, a third transistor T3, a fourth transistor T4, a fifth transistor T5, a sixth transistor T6, a seventh transistor T7, a capacitor C1, and a light-emitting diode D1. From the first transistor T1 to the seventh transistor T7, each of which has a control end, a first electrode, and a second electrode.

The pixel circuit further includes a first scanning signal input end, a second scanning signal input end, a first light emitting control signal input end, a second light emitting control signal input end, and a data signal input end. The first scanning signal input end is respectively connected to the control end of the fourth transistor T4 and the control end of the seventh transistor T7, and is configured to input a first scanning signal SCAN1. The second scanning signal input end is respectively connected to the control end of the second transistor T2 and the control end of the third transistor T3, and is configured to input the second scanning signal SCAN2. The first light emitting control signal input end is connected to the control end of the sixth transistor T6, and is configured to input a first light emitting control signal EM1. The second light emitting control signal input end is connected to the control end of the fifth transistor T5, and is configured to input a second light emitting control signal EM2. Since the first light emitting control signal EM1 is different from the second light emitting control signal EM2, a port of the first light emitting control signal input end is different from a port of the second light emitting control signal input end. The data signal input end is connected to the first electrode of the second transistor T2, and is configured to input the data voltage Vdata.

Specifically, the control end of the fourth transistor T4 is configured to input the first scanning signal SCAN1. The first electrode of the fourth transistor T4 is respectively connected to the second electrode of the third transistor T3, the control end of the first transistor T1, and the first polar plate of the capacitor C1. The second electrode of the fourth transistor T4 is connected to the second electrode of the seventh transistor T7, and is configured to input the first reference voltage Vref1. The control end of the third transistor T3 is configured to input the second scanning signal SCAN2. The first electrode of the third transistor T3 is respectively connected to the second electrode of the first transistor T1 and the first electrode of the sixth transistor T6. The first electrode of the first transistor T1 is configured to input a first power supply voltage VDD. The control end of the sixth transistor T6 is configured to input the first light emitting control signal EM1. The second electrode of the sixth transistor T6 is respectively connected to the anode of the light-emitting diode D1 and the first electrode of the seventh transistor T7. The cathode of the light-emitting diode D1 is configured to input a second power supply voltage VSS. The control end of the seventh transistor T7 is configured to input the first scanning signal SCAN1. The control end of the second transistor T2 is configured to input the second scanning signal SCAN2. The first electrode of the second transistor T2 is configured to input the data voltage Vdata. The second electrode of the second transistor T2 is respectively connected to the second polar plate of the capacitor C1 and the second electrode of the fifth transistor T5. The control end of the fifth transistor T5 is configured to input the second light emitting control signal EM2. The first electrode of the fifth transistor T5 is configured to input a second reference voltage Vref2.

In the present embodiment, the second transistor T2, the third transistor T3, the fourth transistor T4, the fifth transistor T5, the sixth transistor T6, and the seventh transistor T7 are all switching transistors, and the first transistor T1 is a driving transistor. The capacitor C1 is an energy storage capacitor. The light-emitting diode D1 is an Organic Light-Emitting diode (OLED). The transistors in the present embodiment are all P-type transistors. Specifically, the control end of each transistor is a gate of the transistor, the first electrode of each transistor is a source of the transistor, and the second electrode of each transistor is a drain of the transistor. When a low level is applied to the control end of the transistor, the transistor is turned on. Optionally, the transistor may also be N-type transistor. When using N-type transistors in the pixel circuit, each transistor can be switched on by inputting a high level signal to the control end of the transistor.

The first scanning signal SCAN1 can control the fourth transistor T4 and the seventh transistor T7 to switch on, such that the first reference voltage Vref1 is utilized to initialize the gate of the first transistor T1 and the anode of the light-emitting diode D1. The second scanning signal SCAN2 can control the second transistor T2 to switch on, such that the data voltage Vdata is written into the second polar plate of the capacitor C1 through the second transistor T2. The second light emitting control signal EM2 can control the fifth transistor T5 to switch on, such that the second reference voltage Vref2 is utilized to compensate the control end of the first transistor T1 through the capacitor C1.

In the present embodiment, the first power supply voltage VDD can be a positive voltage, and the second power supply voltage VSS can be a negative voltage. The first transistor T1 can be driven under the action of the first power supply voltage VDD to produce a current. The current flows through the light-emitting diode D1, to make the light-emitting diode D1 emit light. When the light-emitting diode D1 emits light, the current flows from the light-emitting diode D1 to the second power supply.

In the pixel circuit provided by the above embodiment, the first light emitting control signal EM1 is provided to initialize the first polar plate of the capacitor C1 and the second light emitting control signal EM2 is provided to initialize the second polar plate of the capacitor C1, in order to ensure that the same initial state of the pixel circuits. The second reference voltage Vref2 is utilized to compensate the control end of the first transistor T1 through the capacitor C1, to make the driving current passing through the first transistor T1 related to the second reference voltage Vref2, and independent of the first power supply voltage VDD. Since the driving current passes through the power supply wire, when the driving current is independent of the first power supply voltage VDD, the driving current is not affected by the current-resistance voltage drop on the power supply wire, thereby improving the uniformity of the light emission of the screen body.

Optionally, the first transistor T1, the second transistor T2, the third transistor T3, the fourth transistor T4, the fifth transistor T5, the sixth transistor T6, and the seventh transistor T7 are all P-type transistors or N-type transistors.

Optionally, the first transistor T1, the second transistor T2, the third transistor T3, the fourth transistor T4, the fifth transistor T5, the sixth transistor T6, and the seventh transistor T7 can be any one of a low-temperature polysilicon thin film transistor, an oxide semiconductor thin film transistor, and an amorphous silicon thin film transistor.

Optionally of the present disclosure, a display panel is provided, which includes a plurality of the above-mentioned pixel circuits arranged in an array. The display panel further includes a data driver, a scanning driver, and a light emitting controller. One end of a first scanning signal wire is connected to the first scanning signal input end of each row of the pixel circuits, one end of a second scanning signal wire is connected to the second scanning signal input end of each row of the pixel circuits, and the other ends of the first and second scanning signal wires are connected to the scanning driver. The scanning driver provides a scanning signal which is transmitted into the pixel circuits through the scanning signal wire. One end of a data signal wire is connected to the data signal input end of each column of the pixel circuits, and the other end is connected to the data driver. The data driver provides a data voltage which is transmitted to the pixel circuits through the data signal wire. One end of each of a plurality of light emitting control signal wires is connected to each row of pixel circuits, and the other end of each of a plurality of light emitting control signal wires is connected to the light emitting controller. The light emitting controller provides a light emitting control signal which is transmitted to the pixel circuits through the light emitting control signal wire.

Optionally of the present disclosure, a display apparatus is provided, which includes the above-mentioned display panel.

Figure 2:
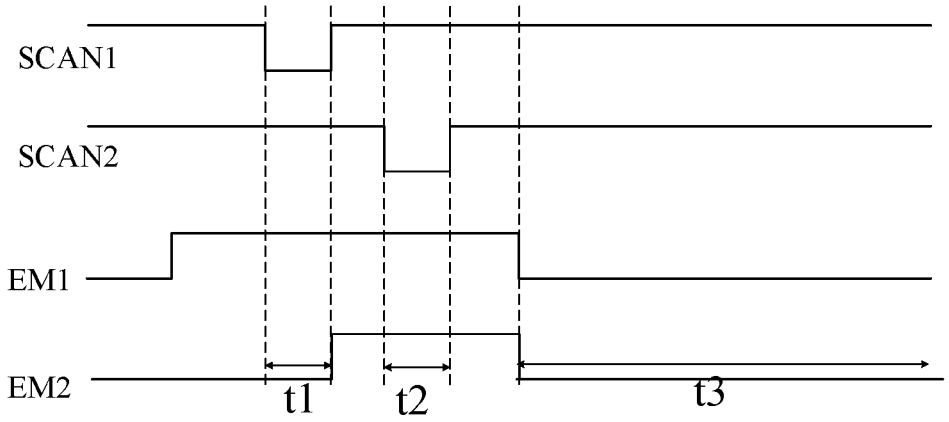
FIG. 2 shows a sequence diagram of a control method for a pixel circuit according to an embodiment of the present disclosure.

Referring to FIGS. 1 and 2, FIG. 1 shows a pixel circuit provided by an embodiment of the present disclosure, and FIG. 2 shows a sequence signal diagram when driving the pixel circuit as shown in FIG. 1. The method for driving the pixel circuit includes following three phases.

During an initialization phase t1, the first scanning signal SCAN1 and the second light emitting control signal EM2 are both low level signals, and the second scanning signal SCAN2 and the first light emitting control signal EM1 are both high level signals, to make the first reference voltage Vref1 utilized to initialize the pixel circuits.

During a data writing phase t2, the second scanning signal SCAN2 is the low level signal; and the first scanning signal SCAN1, the first light emitting control signal EM1, and the second light emitting control signal EM2 are all the high level signals, to make the data voltage Vdata written into the pixel circuits.

During a light emitting phase t3, the first light emitting control signal EM1 and the second light emitting control signal EM2 are both the low level signals, and the first scanning signal SCAN1 and the second scanning signal SCAN2 are both the high level signals, to make the light-emitting diode D1 emit light.

Specifically, during the initialization phase t1, the first scanning signal SCAN1 and the second light emitting control signal EM2 are both the low level. Since the first scanning signal input end is connected to the control end of the fourth transistor T4 and the control end of the seventh transistor T7, and the fourth transistor T4 and the seventh transistor T7 are both the P-type transistors, the first scanning signal SCAN1 controls the fourth transistor T4 and the seventh transistor T7 to switch on. The first reference voltage Vref1 is utilized to initialize the control end of the first transistor T1 and the first polar plate of the capacitor C1 through the fourth transistor T4. Meanwhile, the first reference voltage Vref1 is utilized to initialize the anode of the light-emitting diode D1 through the seventh transistor T7. Since the second light emitting control signal input end is connected to the control end of the fifth transistor T5, and the fifth transistor T5 is a P-type transistor, the second light emitting control signal EM2 controls the fifth transistor T5 to switch on, to make the second reference voltage Vref2 utilized to initialize the second polar plate of the capacitor C1. In the present embodiment, during the initialization phase t1, the first polar plate and the second polar plate of the capacitor C1 are initialized. The electric potential of the first polar plate of the capacitor C1 remains at the first reference voltage Vref1, and the second polar plate of the capacitor C1 remain at the second reference voltage Vref2. Since the light emitting current flows through the first power supply, the first transistor T1, the sixth transistor T6, and the light-emitting diode D1, to the second power supply, the light emitting current doesn't flow through the first reference voltage wire providing the first reference voltage Vref1 and the second reference voltage wire providing the second reference voltage Vref2. Therefore, there is no current-resistance voltage drop on the first reference voltage wire and the second reference voltage wire. Accordingly, the initial state of each pixel circuit is the same, which can better ensure the uniformity of the light emission of the screen body.

During the data writing phase t2, the second scanning signal SCAN2 is the low level signal. Since the second scanning signal input end is connected to the control end of the second transistor T2, and the second transistor T2 is a P-type transistor, the second scanning signal SCAN2 controls the second transistor T2 to switch on. The data voltage Vdata is written to the second polar plate of the capacitor C1 through the second transistor T2, to make the electric potential of the second polar plate of the capacitor C1 be Vdata. In the initialization phase t1, since the first reference voltage Vref1 is utilized to initialize the control end of the first transistor T1 to make the first transistor T1 switched on. In the data writing phase t2, when the circuit state is stable, the electric potential of the first electrode of the first transistor T1 is VDD, and the electric potential of the control end of the first transistor T1 equals to VDD−|Vth|, thereby implementing the compensation for the threshold voltage.

During the light emitting phase t3, the first light emitting control signal EM1 and the second light emitting control signal EM2 are both the low level. The second light emitting control signal EM2 controls the fifth transistor T5 to switch on, to make the second reference voltage Vref2 written to the second polar plate of the capacitor C1. Since the first scanning signal SCAN1 and the second scanning signal SCAN2 are both the high level signals, the fourth transistor T4 and the third transistor T3 are switched off, and the capacitance of the capacitor C1 is much larger than the parasitic capacitance of other transistors, the voltage difference between the two ends of the capacitor C1 is constant. However, the electric potential of the second polar plate of the capacitor C1 is changed from Vdata to Vref2. In accordance with the coupling principle of the capacitor, the electric potential of the first polar plate of the capacitor C1 can also be changed accordingly, that is, the amount of electric potential changes of the first polar plate of the capacitor C1 equals to Vref2−Vdata. The first polar plate of the capacitor C1 is connected to the control end of the first transistor T1. Therefore, the amount of electric potential changes at the control end of the first transistor T1 equals to Vref2−Vdata. Accordingly, the electric potential at the control end of the first transistor T1 equals to VDD−|Vth|+Vref2−Vdata. Since the electric potential of the first electrode of the first transistor T1 is VDD, the gate-source voltage of the first transistor T1 satisfies the equation: Vgs=Vref2−Vdata−|Vth|, where |Vth|=−Vth. According to the following formula of the driving current flowing through the first transistor T1, $I=K*(Vgs-Vth)^2$, it can be known that the driving current flowing through the first transistor T1 is independent of the voltage VDD of the first power supply. Therefore, the effect caused by the current-resistance voltage drop on the driving current on the first power supply wire can be eliminated. The driving current is related to the second reference voltage Vref2. However, since the current flowing through the light-emitting diode D1 doesn't flow through the second reference voltage wire, no current-resistance voltage drop is produced on the second reference voltage wire, thereby improving the uniformity of the light emission of the screen body.

The working principle of the pixel circuit will be described below with reference to FIGS. 1 and 2.

During the initialization phase t1, the first scanning signal SCAN1 and the second light emitting control signal EM2 are both low level signals. The second scanning signal SCAN2 and the first light emitting control signal EM1 are both high level signals. The fourth transistor T4, the fifth transistor T5, and the seventh transistor T7 are switched on, while the second transistor T2, the third transistor T3, and the sixth transistor T6 are switched off.

Since the fourth transistor T4 is switched on, the first reference voltage Vref1 is utilized to initialize the control end of the first transistor T1 and the first polar plate of the capacitor C1 through the fourth transistor T4. The first reference voltage Vref1 can be a negative voltage, and can act on the control end of the first transistor T1 to enable the first transistor T1 to switch on. Since the seventh transistor T7 is switched on, the first reference voltage Vref1 is utilized to initialize the anode of the light-emitting diode D1. Since the fifth transistor T5 is switched on, the second reference voltage Vref2 is utilized to initialize the second polar plate of the capacitor C1 through the fifth transistor T5.

The voltage value of the first reference voltage Vref1 is less than the voltage value of the second power supply voltage VSS, to ensure that the light-emitting diode D1 doesn't emit light during the initialization. The initialization can eliminate the effect of the residual current from the previous light-emitting phase on the present light-emitting phase. Moreover, the initialization of the first and second polar plates of the capacitor C1 can ensure that all the pixel circuits are in the same initial state, thereby improving the uniformity of the light emission of the screen body.

During the data writing phase t2, the second scanning signal SCAN2 is the low level signal, while and the first scanning signal SCAN1, the first light emitting control signal EM1, and the second light emitting control signal EM2 are the high level signals. The second transistor T2 and the third transistor T3 are switched on. In the initialization phase, the first transistor T1 has been switched on. The fourth transistor T4, the fifth transistor T5, the sixth transistor T6, and the seventh transistor T7 are switched off.

Since the second transistor T2 is switched on, the data voltage Vdata is written into the second polar plate of the capacitor C1 through the second transistor T2, to make the electric potential of the second polar plate of the capacitor C1 be Vdata. Since the first transistor T1 is switched on, the first power supply charges the first electrode of the first transistor T1. When the circuit state is stable, the electric potential of the first electrode of the first transistor T1 is VDD, and the electric potential of the control end of the first transistor T1 equals to VDD−|Vth|, thereby implementing the compensation for the threshold voltage of the first transistor T1.

During the light emitting phase t3, the first light emitting control signal EM1 and the second light emitting control signal EM2 are both low level signals, and the first scanning signal SCAN1 and the second scanning signal SCAN2 are both high level signals. The fifth transistor T5 and the sixth transistor T6 are switched on, and the first transistor T1 remains the on state. The second transistor T2, the third transistor T3, the fourth transistor T4, and the seventh transistor T7 are switched off.

Since the fifth transistor T5 is switched on, and the second reference voltage Vref2 is written into the second polar plate of the capacitor C1 through the fifth transistor T5, the electric potential of the second polar plate of the capacitor C1 is changed from Vdata to Vref2. Since the fourth transistor T4 and the third transistor T3 are switched off, and the capacitance of the capacitor C1 is much larger than the parasitic capacitance of other transistors, the voltage difference of the capacitor C1 is constant. According to the coupling principle of the capacitor, in the case where the voltage difference of the capacitor C1 remains constant, the electric potential of the first polar plate of the capacitor C1 can also be changed with the electric potential of the second polar plate. The electric potential of the second polar plate of the capacitor C1 is changed from the Vdata in the data writing phase t2 to Vref2 in the light emitting phase t3, and the change equals to Vref2−Vdata, accordingly the change in the electric potential of the first polar plate of the capacitor C1 is the same as the change in the electric potential of the second polar plate of the capacitor C1. Since the control end of the first transistor T1 is connected to the first polar plate of the capacitor C1, the change in the electric potential of the control end of the first transistor T1 is the same as the change in the electric potential of the first polar plate. Therefore, during the data writing phase t2, the electric potential of the control end of the first transistor T1 equals to VDD−|Vth|+Vref2−Vdata. Accordingly, the gate-source voltage Vgs of the first transistor T1 satisfies the following formula: Vgs=VDD−|Vth|+Vref2−Vdata−VDD=Vref2−Vdata−|Vth|. The driving current flowing through the first transistor T1 satisfies the following formula:

$$I=K*(Vgs-Vth)^2=K*(Vref2-Vdata-|Vth|+|Vth|)^2=K*(Vref2-Vdata)^2.$$

Where K=½*μ*Cox*W/L, μ is an electron mobility of the first transistor T1, Cox is the gate oxide layer capacitance per unit area of the first transistor T1, W is the channel width of the first transistor T1, and L is the channel length of the first transistor T1. The driving current flowing through the first transistor T1 is the light emitting current which flows through the light-emitting diode D1. From the above formula it can be seen that the light emitting current flowing through the light-emitting diode D1 is independent of the first power supply voltage VDD and the threshold voltage of the transistor. Meanwhile, the light emitting current doesn't flow through the second reference voltage wire. Therefore, the circuit structure and the method for driving the circuit provided by the embodiments of the present disclosure compensate for the current-resistance voltage drop on the first power supply wire by means of adding the second reference voltage. Meanwhile, the circuit structure and the method for driving the circuit provided by the embodiments of the present disclosure also compensate the effect of the threshold voltage on the light emitting current, thereby improving the uniformity of the light emission of the screen body.

The technical features in the above embodiments can be employed in arbitrary combinations. For purpose of simplifying the description, all possible combinations of the technical features in the above embodiments are not described. However, as long as there is no contradiction in the combinations of the technical features, they should be considered as within the scope of the disclosure.

The above embodiments are merely several exemplary embodiments of the disclosure, and the descriptions thereof are more specific and detailed, but should not be interpreted as limitation to the scope of the present disclosure. It should be noted that a number of variations and improvements can be made by those skilled in the art without departing from the conception of the present disclosure, which all fall within the scope of the present disclosure. Therefore, the scope of the present disclosure should be subject to the appended claims.

The invention claimed is:

1. A pixel circuit comprising: a first transistor, a second transistor, a third transistor, a fourth transistor, a fifth transistor, a sixth transistor, a seventh transistor, a capacitor, and a light-emitting diode, wherein:

a control end of the fourth transistor is configured to input a first scanning signal; a first electrode of the fourth transistor is respectively connected to a second electrode of the third transistor, a control end of the first transistor, and a first polar plate of the capacitor; a second electrode of the fourth transistor is connected to a second electrode of the seventh transistor and is configured to input a first reference voltage;

a control end of the third transistor is configured to input a second scanning signal, a first electrode of the third transistor is respectively connected to a second electrode of the first transistor and a first electrode of the sixth transistor, a first electrode of the first transistor is configured to input a first power supply voltage;

a control end of the sixth transistor is configured to input a first light emitting control signal, a second electrode of the sixth transistor is respectively connected to an anode of the light-emitting diode and a first electrode of the seventh transistor, a cathode of the light-emitting diode is configured to input a second power supply voltage, a control end of the seventh transistor is configured to input the first scanning signal;

a control end of the second transistor is configured to input the second scanning signal, a first electrode of the second transistor is configured to input a data voltage, a second electrode of the second transistor is respectively connected to a second polar plate of the capacitor and a second electrode of the fifth transistor; and a control end of the fifth transistor is configured to input a second light emitting control signal, a first electrode of the fifth transistor is configured to input a second reference voltage.

2. The pixel circuit according to claim 1, wherein a voltage value of the first reference voltage is less than a voltage value of the second power supply voltage.

3. The pixel circuit according to claim 1, wherein the first transistor, the second transistor, the third transistor, the fourth transistor, the fifth transistor, the sixth transistor, and the seventh transistor are P-type transistors or N-type transistors.

4. The pixel circuit according to claim 1, wherein the first transistor, the second transistor, the third transistor, the fourth transistor, the fifth transistor, the sixth transistor, and the seventh transistor comprise any one of a low-temperature polysilicon thin film transistor, an oxide semiconductor thin film transistor, and an amorphous silicon thin film transistor.

5. The pixel circuit according to claim 1, wherein the second transistor, the third transistor, the fourth transistor, the fifth transistor, the sixth transistor, and the seventh transistor are switching transistors, and the first transistor is a driving transistor.

6. The pixel circuit according to claim 1, wherein the capacitor is an energy storage capacitor, the light-emitting diode is an organic light-emitting diode.

7. The pixel circuit according to claim 1, wherein a control end of each transistor is a gate of the each transistor, a first electrode of each transistor is a source of the each transistor, and a second electrode of each transistor is a drain of the each transistor.

8. The pixel circuit according to claim 1, wherein the first power supply voltage is a positive voltage, and the second power supply voltage is a negative voltage.

9. A display panel, comprising a plurality of pixel circuits arranged in an array, wherein each of the pixel circuits is the pixel circuit of claim 1.

10. A display apparatus, comprising the display panel of claim 9.

11. A method for driving a pixel circuit, the pixel circuit comprising a first transistor, a second transistor, a third transistor, a fourth transistor, a fifth transistor, a sixth transistor, a seventh transistor, a capacitor, and a light-emitting diode, wherein:

a control end of the fourth transistor is configured to input a first scanning signal; a first electrode of the fourth transistor is respectively connected to a second electrode of the third transistor, a control end of the first transistor, and a first polar plate of the capacitor; a second electrode of the fourth transistor is connected to a second electrode of the seventh transistor and is configured to input a first reference voltage;

a control end of the third transistor is configured to input a second scanning signal, a first electrode of the third transistor is respectively connected to a second electrode of the first transistor and a first electrode of the sixth transistor, a first electrode of the first transistor is configured to input a first power supply voltage;

a control end of the sixth transistor is configured to input a first light emitting control signal, a second electrode of the sixth transistor is respectively connected to an anode of the light-emitting diode and a first electrode of the seventh transistor, a cathode of the light-emitting diode is configured to input a second power supply voltage, a control end of the seventh transistor is configured to input the first scanning signal;

a control end of the second transistor is configured to input the second scanning signal, a first electrode of the second transistor is configured to input a data voltage, a second electrode of the second transistor is respectively connected to a second polar plate of the capacitor and a second electrode of the fifth transistor; and a control end of the fifth transistor is configured to input a second light emitting control signal, a first electrode of the fifth transistor is configured to input a second reference voltage;

wherein the driving method comprising:

during an initialization phase, setting the first scanning signal and the second light emitting control signal as a low level signal, setting the second scanning signal and the first light emitting control signal as a high level signal, and utilizing the first reference voltage to initialize the pixel circuit;

during a data writing phase, setting the second scanning signal as a low level signal, setting the first scanning signal, the first light emitting control signal and the second light emitting control signal as a high level signal, and writing the data voltage into the pixel circuit; and during a light emitting phase, setting the first light emitting control signal and the second light emitting control signal as a low level signal, setting the first scanning signal and the second scanning signal as a high level signal, the light-emitting diode emitting light.

12. The method for driving the pixel circuit according to claim 11, wherein during the initialization phase, the first scanning signal controls the fourth transistor and the seventh transistor to switch on;

the first reference voltage is utilized to initialize a control end of the first transistor and a first polar plate of a capacitor through a fourth transistor, the first transistor switched on; the first reference voltage is utilized to initialize an anode of the light-emitting diode through a seventh transistor; and the second light emitting control signal controls a fifth transistor to switch on, a second reference voltage is utilized to initialize a second polar plate of the capacitor through the fifth transistor.

13. The method for driving the pixel circuit according to claim 12, wherein a voltage value of the first reference voltage is less than a voltage value of the second power supply voltage to ensure that the light-emitting diode doesn't emit light during the initializing phase.

14. The method for driving the pixel circuit according to claim 12, wherein during the data writing phase, the second scanning signal controls the second transistor to switch on, the data voltage is written into the second polar plate of the capacitor through the second transistor.

15. The method for driving the pixel circuit according to claim 14, wherein during the light emitting phase, the second light emitting control signal controls the fifth transistor to switch on, the second reference voltage is utilized to compensate for a voltage of the first transistor through the fifth transistor and the capacitor, to make a current flowing through the first transistor independent of the first power supply voltage.

* * * * *